US005308217A

United States Patent [19]

Pienta

[11] Patent Number: 5,308,217

[45] Date of Patent: May 3, 1994

[54] ROLL CHUCKING APPARATUS

[75] Inventor: David J. Pienta, Temperance, Mich.

[73] Assignee: Automatic Handling, Inc., Erie, Mich.

[21] Appl. No.: 915,261

[22] Filed: Jul. 20, 1992

[51] Int. Cl.[5] ..... B66F 3/22

[52] U.S. Cl. ..... 414/610; 414/21; 414/908; 414/910; 414/911; 414/925; 242/57; 242/68.4; 242/58.6

[58] Field of Search ..... 414/592, 21, 910, 911, 414/925, 610, 908; 242/57, 68.4, 58.6, 78.6

[56] References Cited

U.S. PATENT DOCUMENTS 2,829,863 4/1958 Gibson ..... 414/592 X
4,927,091 5/1990 Weiss et al. ..... 242/68.4
5,174,710 12/1992 Dragos ..... 414/910 X

FOREIGN PATENT DOCUMENTS 0086347 5/1986 Japan ..... 242/57
0006016 1/1990 Japan ..... 242/78.6

*Primary Examiner*—Michael S. Huppert
*Assistant Examiner*—Donald W. Underwood
*Attorney, Agent, or Firm*—Emch, Schaffer, Schaub & Porcello

[57] ABSTRACT

A roll chucking apparatus is disclosed. The roll defines opposed side openings. The roll chucking apparatus includes a platform from supporting the roll. Lift structures vertically adjust the platform. Sensing structures sense an increase or decrease in the platform load upon the attempted initial insertion of opposed chucking pins into the opposed side openings. The lift structures vertically moves the platform and the roll until correct vertical alignment with the chucking pins occurs.

5 Claims, 3 Drawing Sheets

ROLL CHUCKING APPARATUS

BACKGROUND OF THE INVENTION

The present invention is directed to a chucking apparatus and more particularly for a roll chucking apparatus directed to, for examples, paper rolls and metal rolls.

Paper and metal are often placed on rolls and shipped to a further processing location. In the case of paper rolls, they are often utilized in newspaper apparatus. Metal rolls, such as rolls of steel or non-ferrous alloys such as copper and brass are shipped to factories or other metal working facilities for further processing.

To move the rolls, it is often necessary to chuck the rolls. During this process, chucking pins are inserted into opposed side openings in the roll. A problem well known in the prior art is that the chucking sometimes results in crushing or otherwise damaging the side edges of the rolled paper or the rolled metal.

To alleviate this problem, computers have been utilized to determine the location of the openings in the paper roll. In response to computer readouts, the chucking pins are moved in a predetermined path. However, it has been found that because of differences in the materials themselves and in the alignment of the rolls, damage still sometimes occurs when the chucking pins engage the paper or metal rather than directly moving into the opposed openings.

The primary object of the roll chucking apparatus, according to the present invention, is to provide an improved chucking apparatus for movement of the chucking pins into the opposed central openings in the side edges of a paper or metal roll, without damaging the rolled material.

STATEMENT OF THE INVENTION

The present invention is directed to a roll chucking apparatus for use with a roll having roll ends, each of the ends defining a central opening. The opposed central openings in the side edges of the roll receive opposed support pins which engage and support the roll. Normally after chucking, the roll is moved from the chucking station to another station such as a machine or press for a further operation. The chucking apparatus includes a platform for supporting the roll. Lift means are provided for vertically adjusting the platform. A load cell means is provided for sensing an increase or decrease in the platform load upon an attempted insertion of the opposed chucking pins into the central side openings of the roll. The platform of the chucking apparatus is moved vertically in response to the reading of the load cell means to vertically align the side openings in the roll with respective ones of the opposed chucking pins.

DESCRIPTION OF THE PREFERRED EMBODIMENT

Figure 1:
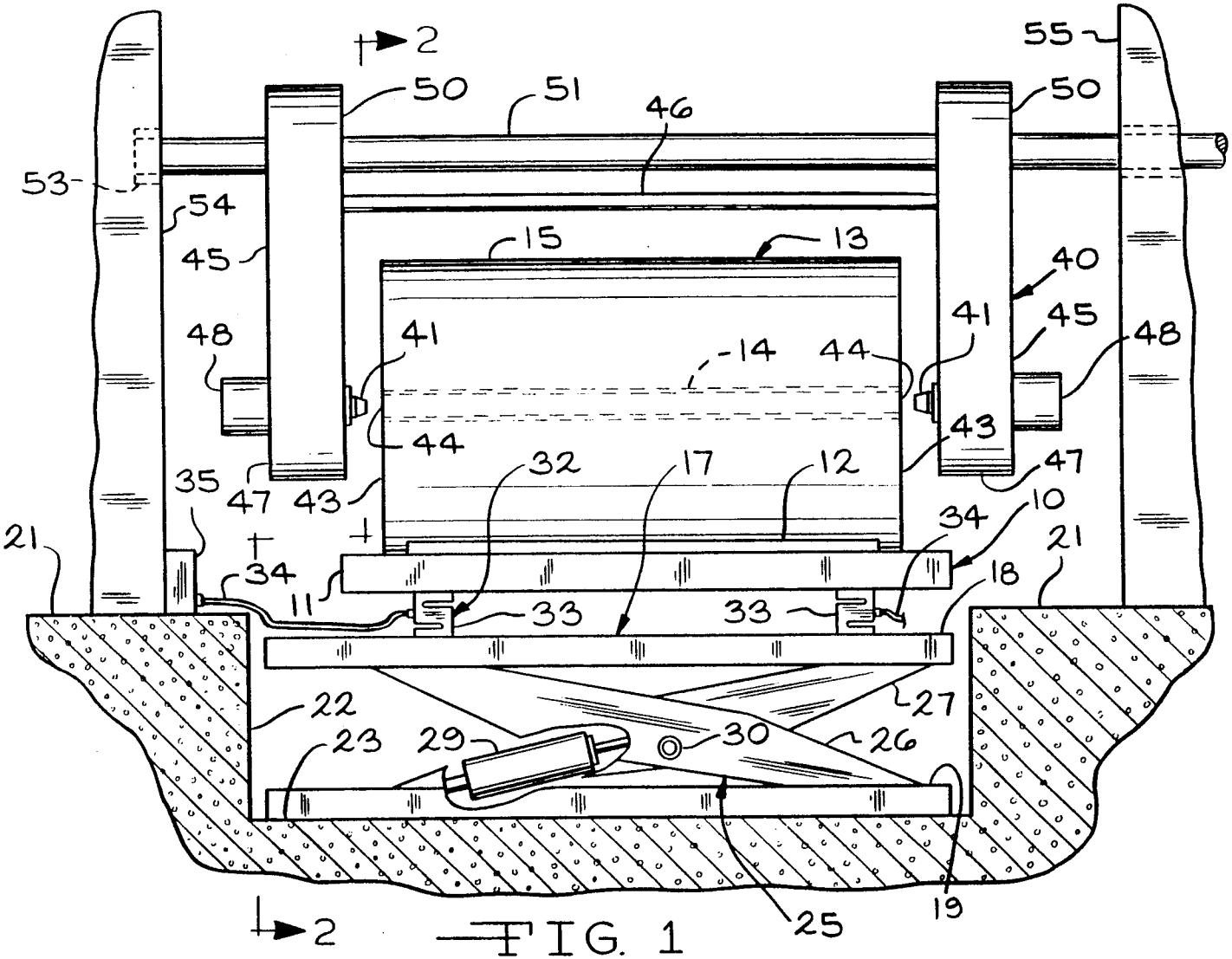
FIG. 1 is an end elevational view of a roll chucking apparatus, according to the present invention, shown partially in cross section.

A roll chucking apparatus, according to the present invention, is generally indicated by the reference number 10 in FIG. 1. The roll chucking apparatus 10 includes a platform 11. A cradle 12 is mounted on the upper surface of the platform 11 and receives a roll, such as a paper roll 13. While a paper roll 13 has been illustrated, the roll chucking apparatus 10 may be utilized in connection with many types of rolls and cylinders. For example, the roll chucking apparatus 10 may also be used with plastic rolls or metallic rolls composed of metals such as steel, brass, copper and other metal alloys.

The paper roll 13 includes a cylindrical core 14 having a continuous layer of paper 15 rolled thereon, which forms the overall paper roll 13.

The roll chucking apparatus 10 includes lift means 17 for vertically adjusting the platform 11. In the present embodiment, the lift means 17 includes an upper frame 18 and a lower frame 19. A concrete floor 21 defines a pit 22 having a bottom surface 23. The lower frame 19 of the lift means 17 is positioned on the bottom surface 23 of the pit 22. A scissors mechanism 25 having opposed pairs of pivotally mounted arms 26 and 27 interconnect the upper frame 18 to the lower frame 19. A prior art scissors mechanism of this type is sold by Southworth. The pairs of pivotally mounted arms 26 and 27 are opened and closed by a pair of cylinders 29. The cylinders 29 are connected to a pivot shaft assembly 30 which extends between the pairs of arms 26 and 27. While the lift means 17, in the present embodiment, has been shown as a scissors mechanism, other types of lift means may be utilized and fall within the scope of the present invention.

Figure 2:
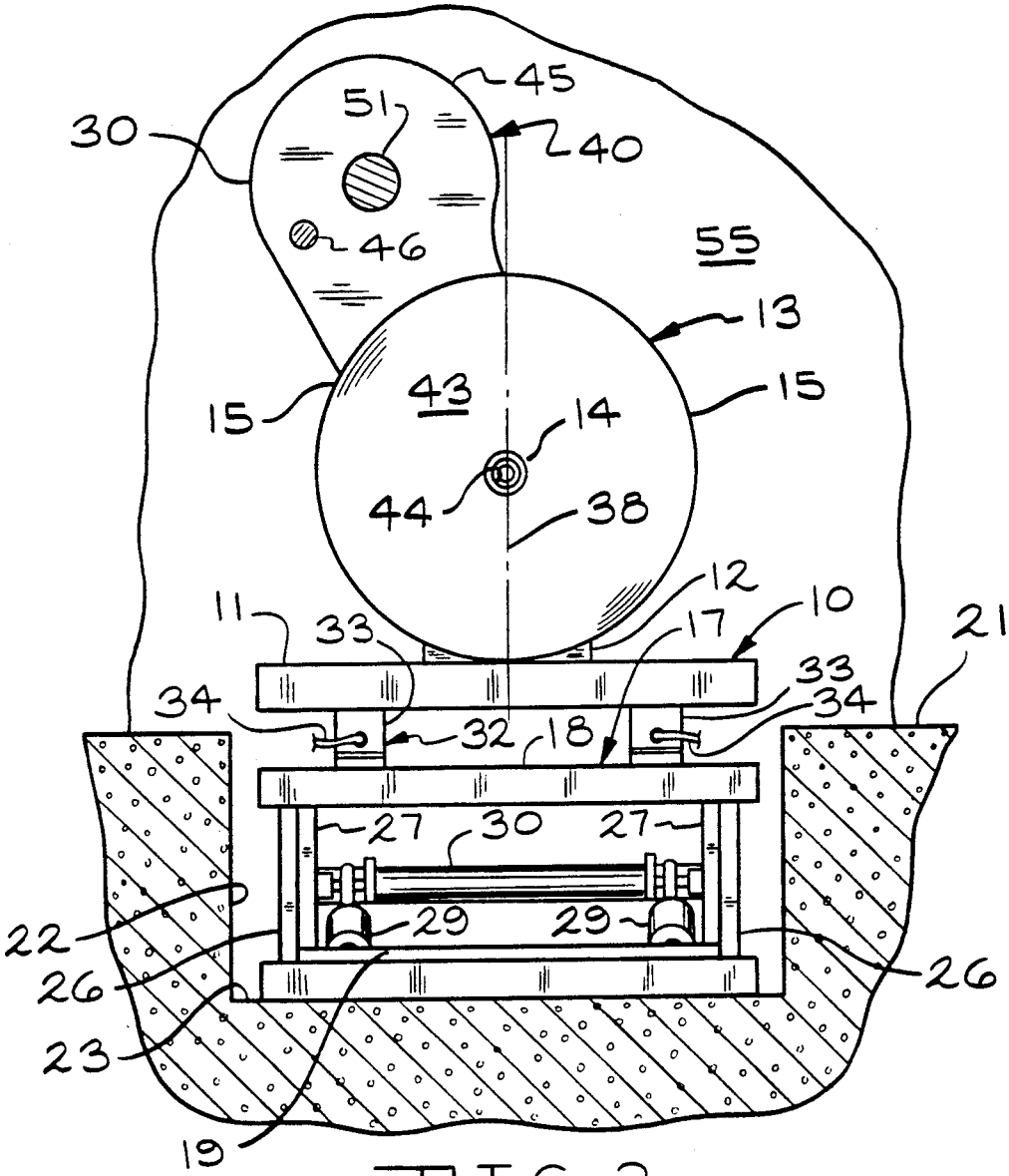
FIG. 2 is a fragmentary sectional view taken along the line 2—2 of FIG. 1.
Figure 3:
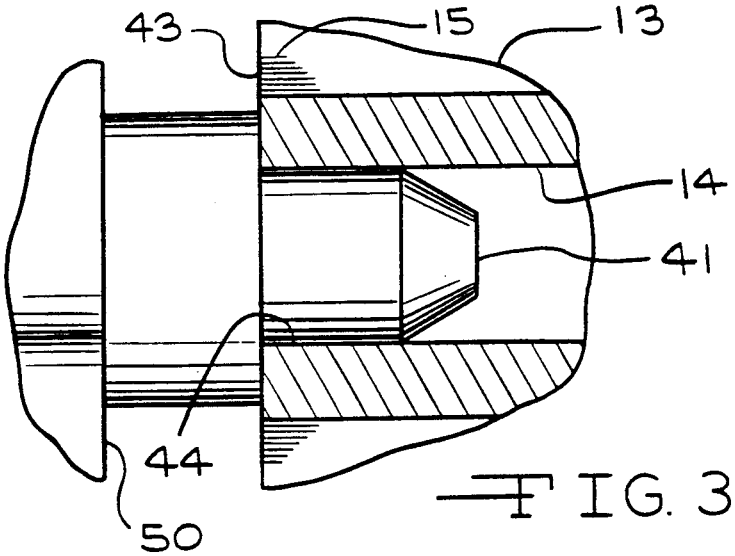
FIG. 3 is a fragmentary cross sectional view showing a chucking pin inserted in the central opening of a roll.

A sensing means 32 is positioned adjacent the platform 11. In the present embodiment, the sensing means 32 comprise a plurality of load cells 33 which are connected by conduits 34 to a control box 35. One prior art load cell which can be utilized is the Toledo 951 load cell assembly sold by the Toledo Scale Corporation. In the present embodiment, four load cells 33 are mounted generally adjacent the four corners of the platform 11. The control box 35 includes a micro processor which receives signals from the individual load cells 33 and, if required, transmits a signal to the cylinders 29. The cylinders 29 are extended or retracted to vertically adjust the platform 11 and the paper roll 13. As shown in FIG. 2, an axis 38 of the cradle 12 intersects the center of the core 14 of the paper roll 13 when the paper roll 13 is positioned on the cradle 12. Therefore, the paper roll 13 is correctly aligned horizontally when initially positioned in the cradle 12.

A roll handling apparatus is generally indicated by the reference number 40 in FIGS. 1 and 2. The roll handling apparatus 40 includes movable opposed chucking supports or pins 41. The paper roll 13 includes opposed side edges 43. The side edges 43 include opposed central openings 44 which are defined by the core 14. During the chucking process, the opposed chucking pins 41, after alignment, are inserted into the paper roll openings 44 and the roll handling 40 then normally transfers the paper roll 13 to another work station. The roll handling apparatus 40 is known in the art and is not the subject matter of the present invention. The roll chucking apparatus 10, according to the present invention, can be used with various types of roll handling apparatus other than the roll handling apparatus 40 shown in the drawings.

The roll handling apparatus 40 includes a pair of opposed arms 45 which are interconnected by a shaft 46. Lower ends 47 of the arms 45 mount the opposed chucking pins 41. The pins 41 are reciprocated by cylinders 48. The upper ends 50 of the arms 45 are fixed to a rotatable shaft 51. One end of the rotatable shaft 51 is journaled by a bearing 53 carried by a member 54. The other end of the rotatable shaft 51 extends through a member 55 and is connected to a drive means (not shown) for rotating the shaft.

When it is desired to move the paper roll 13 from the position shown in FIG. 1, the chucking pins 41 are moved into position in the openings 44 defined by the core 14. The platform 11 is lowered and the shaft 51 rotated to swing the paper roll 13 to its next station.

After the paper roll 13 is placed in the cradle 12 and before the chucking pins 41 have been moved inwardly, as noted above, the cradle 12 ensures correct horizontal alignment with the axis 38 (see FIG. 2). Next, the controls of the control box 35 are activated and the cylinders 48 are extended to move the opposed chucking pins 41 inwardly toward the openings 44 defined by the core 14.

Figure 4:
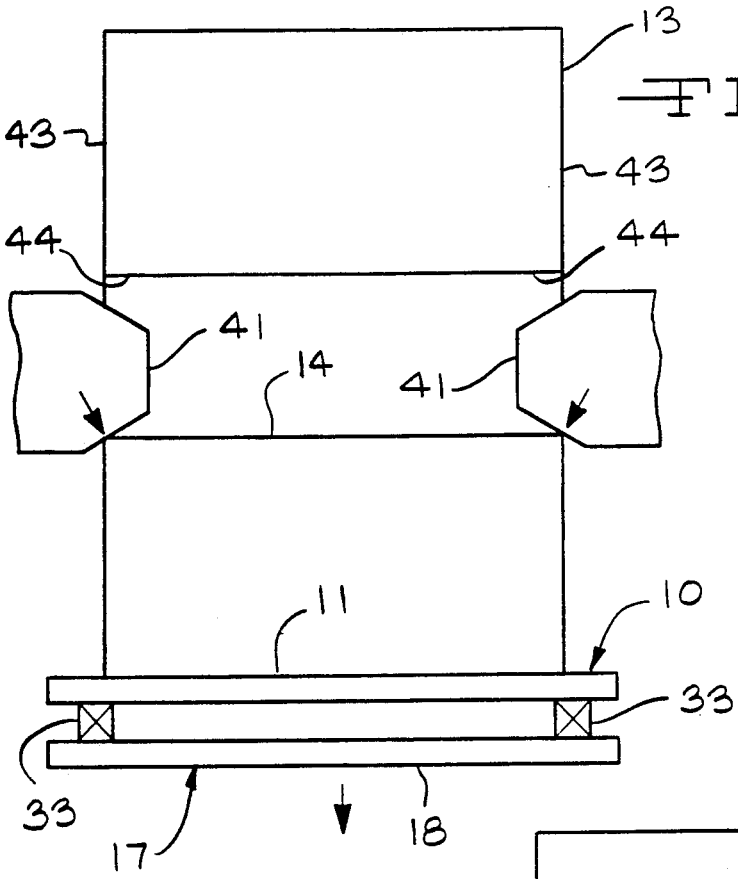
FIG. 4 is a diagrammatic view of a roll chucking apparatus, according to the present invention, showing the opposed chucking pins engaging the lower portion of the roll core.
Figure 5:
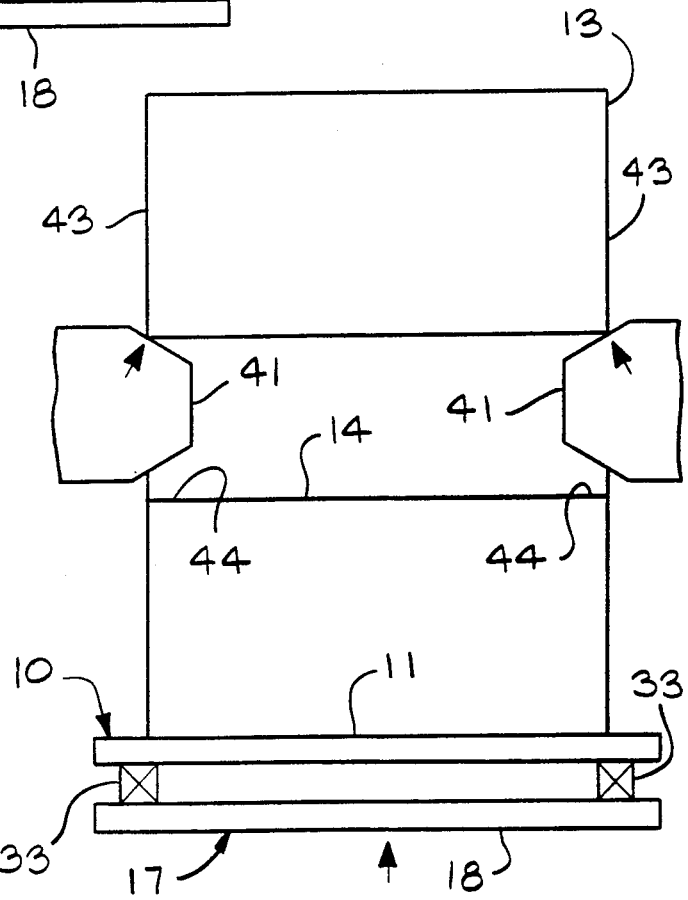
FIG. 5 is a view similar to FIG. 4 showing the opposed chucking pins engaging the upper portion of the roll core.

FIGS. 4 and 5 are diagrammatic views showing the operation of the roll chucking apparatus 10. FIG. 4 shows the roll chucking apparatus 10 when the roll 13 is spaced vertically upwardly from its correct alignment with the opposed chucking pins 41. FIG. 5 illustrates the situation where the paper roll 13 is misaligned vertically downwardly from the correct alignment with the chucking pins 41.

When the paper roll 13 is misaligned upwardly, as shown in FIG. 4, the chucking pins 41 initially engage the core 14, and as indicated by the arrows, place a downward load on the platform 11. This downward load is immediately sensed by the load cells 33 which transmit a signal to the control box 35 which actuates the pairs of cylinders 29 to move the platform 11 incrementally downwardly until the openings 44 are correctly aligned with the opposed chucking pins 41. In the present embodiment, the four load cells 33 detect an increase or decrease in the pressure or load. The lift means 17 moves the platform 11 in a jogging motion until a neutral pressure is sensed which indicates that the openings 44 defined by the core 14 are correctly aligned for insertion of the opposed chucking pins 41.

Similarly, referring to FIG. 5, if the paper roll 13 is positioned vertically downwardly, the opposed chucking pins 41 initially impose an upward pressure or load. Accordingly, the lift means 17 moves the platform 11 in a jogging motion upwardly until a neutral pressure is sensed indicating that the openings 44 are correctly aligned with for insertion of the chucking pins 41.

Many revisions may be made from the above described embodiment without departing from the scope of the invention and of the following claims.

I claim:

1. Roll chucking apparatus for a roll having roll ends and a central opening in each roll end, such roll being engaged at such roll ends by opposed support pins, said chucking apparatus comprising, in combination, a platform for supporting such roll, said platform defining four corners, lift means for vertically adjusting said platform and means for sensing an increase or decrease in the platform load upon initial insertion of such opposed pins into such opposed openings, said sensing means including four load cells positioned adjacent said four corners of said platform and a control box operatively connected between said plurality of load cells and said lift means, whereby upon misalignment of said opposed openings said platform is moved vertically to obtain a neutral load and thus to align such opposed pins with respective ones of said opposed openings.

2. Roll chucking apparatus, according to claim 1, wherein said lift means comprise a lift mounted below said platform for vertically adjusting said platform.

3. Roll chucking apparatus, according to claim 1, wherein four load cells are positioned below and adjacent said platform.

4. Roll chucking apparatus, according to claim 1, including a cradle positioned on said platform for receiving such roll, said cradle horizontally aligning such roll.

5. Roll chucking apparatus, according to claim 2, wherein said lift means comprises a scissors lift mounted below said platform.

* * * * *